US010168120B2

(12) United States Patent
Kincel et al.

(10) Patent No.: US 10,168,120 B2
(45) **Date of Patent: *Jan. 1, 2019**

(54) ADAPTIVE CONFIGURATION FOR A FIREARM

(71) Applicant: Abrams Airborne Manufacturing Inc., Tucson, AZ (US)

(72) Inventors: Eric Stephen Kincel, Las Vegas, NV (US); Gustavo Torres Palacios, Tucson, AZ (US)

(73) Assignee: Abrams Airborne Manufacturing Inc., Tucson, AZ (US)

( * ) Notice: Subject to any disclaimer, the term of this patent is extended or adjusted under 35 U.S.C. 154(b) by 102 days.

This patent is subject to a terminal disclaimer.

(21) Appl. No.: 15/295,775

(22) Filed: Oct. 17, 2016

(65) Prior Publication Data

US 2018/0340752 A1 Nov. 29, 2018

Related U.S. Application Data

(63) Continuation of application No. 11/879,650, filed on Jul. 18, 2007, now Pat. No. 9,470,472.

(51) Int. Cl.
*F41C 23/16* (2006.01)
*F41G 11/00* (2006.01)

(52) U.S. Cl.
CPC ..... *F41C 23/16* (2013.01); *F41G 11/003* (2013.01)

(58) Field of Classification Search
CPC ..... F41C 23/16; F41G 11/003
USPC ..... 42/71.01, 75.03, 75.1
See application file for complete search history.

(56) References Cited

U.S. PATENT DOCUMENTS

| | | | |
|---|---|---|---|
| 2,447,091 | A | 8/1948 | Pope |
| 3,075,314 | A | 1/1963 | Bakker |
| 3,090,150 | A | 5/1963 | Stoner |
| 3,198,076 | A | 8/1965 | Stoner |
| 3,830,003 | A | 8/1974 | Clerke |
| 4,536,982 | A | 8/1985 | Bredbury |
| 4,765,224 | A | 8/1988 | Morris |
| 5,010,676 | A | 4/1991 | Kennedy |
| 5,155,284 | A | 10/1992 | Flashkes |
| 5,198,600 | A | 3/1993 | E'Nama |
| 5,305,539 | A | 4/1994 | Von Kuster |
| 5,343,650 | A | 9/1994 | Swan |
| 5,590,484 | A | 1/1997 | Money |
| 5,826,363 | A | 10/1998 | Olson |
| 6,134,823 | A | 10/2000 | Griffin |
| 6,293,040 | B1 | 9/2001 | Luth |
| 6,481,144 | B1 | 11/2002 | Chee |
| 6,487,806 | B2 | 12/2002 | Murello |
| 6,499,245 | B1 | 12/2002 | Swan |
| 6,508,027 | B1 | 1/2003 | Kim |
| 6,671,990 | B1 | 1/2004 | Booth |
| 6,679,711 | B2 | 1/2004 | Takahashi |
| 6,694,660 | B1 | 2/2004 | Davies |
| 6,779,288 | B1 | 8/2004 | Kim |

(Continued)

*Primary Examiner* — J. Woodrow Eldred
(74) *Attorney, Agent, or Firm* — Fay Sharpe LLP

(57) ABSTRACT

A combination for a firearm which creates an improved firearm. An upper chassis is created which is formed from a first housing and a second housing which, once independently formed, are permanently secured to each other. The upper chassis provides a first opening through which a spent cartridge is discharged and a second opening which permits a variety of attachments to be selectively attached to the upper chassis to customize the firearm to the user and activity.

20 Claims, 3 Drawing Sheets

(56) References Cited

U.S. PATENT DOCUMENTS

| | | | |
|---|---|---|---|
| 6,854,206 | B2 | 2/2005 | Oz |
| 6,895,708 | B2 | 5/2005 | Kim |
| 6,931,775 | B2 | 8/2005 | Burnett |
| 7,131,228 | B2 | 11/2006 | Hochstrate |
| 2002/0000059 | A1 | 1/2002 | Murello |
| 2005/0188591 | A1 | 9/2005 | Stone |
| 2005/0235546 | A1 | 10/2005 | Wonisch |
| 2005/0262752 | A1 | 12/2005 | Robinson |
| 2006/0032103 | A1 | 2/2006 | Wossner |
| 2006/0236582 | A1 | 10/2006 | Lewis |
| 2007/0017139 | A1 | 1/2007 | Larue |

ADAPTIVE CONFIGURATION FOR A FIREARM

This application is a continuation of U.S. application Ser. No. 11/879,650, filed on Dec. 8, 2011, now U.S. Pat. No. 9,470,472, which issued on Oct. 18, 2016, the subject matter of which is hereby incorporated herein by reference in its entirety.

BACKGROUND OF THE INVENTION

This invention relates generally to firearms and more particularly to attachments which tailor the firearm to particular uses.

The use of automatic and semi-automatic rifles is commonly known to be prevalent with military, law enforcement and security forces, as well as civilian collectors, sportsmen and competitive marksmen. One such prolific design is the family of rifles based on the U.S. Military M16 rifle, including the M4 carbine, the civilian AR15, and the larger AR10 and all improvements, modifications and variations of these. Any of these rifles can be further adapted for single shot action. Variations of these rifles are found in numerous military, commercial and experimental calibers.

While there are many conventional firearms that have an integral mounting rail and hand guard, the M16/AR15 family of rifles uses a distinctly separate mounting rail and hand guard assembly. The conventional mounting rail mounts by tabs to the lower receiver. The rifle's barrel mounts to the mounting rail and the conventional hand guards mount to the barrel. This arrangement places the hand guard mounted to the barrel and in contact with the rifle barrel, which is detrimental to accuracy. This method also does not provide for solid mounting or consistent positioning of peripheral devices mounted to the hand guard.

Earlier developments have provided improved hand guard systems that utilize replacement hand guard assemblies that attach by clamping, screwing or slipping over a standard or proprietary barrel nut, clamping to the front or rear sight mounting platforms, or both. These hand guard systems often include multiple rails for attachment of peripheral devices. More current developments have provided monolithic receiver and hand guard platforms, these efforts are manufactured from a solid, homogeneous piece of stock. This manufacturing technique requires the use of a proprietary barrel and does not allow for the use of standard M16/AR15 barrels.

It is clear from the foregoing that there is a need for a more versatile firearm.

REFERENCES

The following references relate to this technology: U.S. Pat. No. 2,447,091, entitled "Interchangeable Gun Barrel and Stock" issued to Pope on Aug. 17, 1948; U.S. Pat. No. 3,075,314, entitled, "Hand Guard for Rifles" issued to Bakker on Jan. 29, 1963; U.S. Pat. No. 3,090,150, entitled "Hand Guard Construction" issued to Stoner on May 21, 1963; U.S. Pat. No. 3,198,076, entitled "Convertible Gun" issued to Stoner on Aug. 3, 1965; U.S. Pat. No. 3,830,003, entitled "Floated Barrel Rifle with Metal Stock for Improved Barrel Action Bedding" issued to Clerke on Aug. 20, 1974; U.S. Pat. No. 4,536,982, entitled "Cylindrical Rifle Handguard Assembly" issued to Bredbury et al. On Aug. 27, 1985; U.S. Pat. No. 5,010,676, entitled "Hand Guard for Firearms" issued to Kennedy on Apr. 30, 1991; U.S. Pat. No. 4,765,224, entitled "Automatic Rifle Gas System" issued to Morris on Aug. 23, 1988; U.S. Pat. No. 5,155,284, entitled "Machine Guns Barrel Locking Mechanism" issued to Flashkes on Oct. 13, 1992; U.S. Pat. No. 5,198,600, entitled "Mount for Rifle" issued to E'Nama on Mar. 30, 1993; U.S. Pat. No. 5,305,539, entitled "Collapsible Firearm Device" issued to Von Kuster on Apr. 26, 1994; U.S. Pat. No. 5,343,650, entitled "Extended Rigid Frame Receiver Sleeve" issued to Swan on Sep. 6, 1994; U.S. Pat. No. 5,590,484, entitled "Universal Mount for Rifle" issued to Money et al. On Jan. 7, 1997; U.S. Pat. No. 5,826,363, entitled "Rail Adapter Handguard Systems for Firearms" issued to Olson on Oct. 27, 1998; U.S. Pat. No. 6,134,823, entitled "Apparatus for Attaching a Supplemental Device to a Minimally Altered Host Firearm" issued to Griffin on Oct. 24, 2000; U.S. Pat. No. 6,293,040, entitled "Interchangeable Weapon Receiver for Alternate Ammunition" issued to Luth on Sep. 25, 2001; U.S. Pat. No. 6,481,144, entitled "Firearm" issued to Chee et al. on Nov. 19, 2002; U.S. Pat. No. 6,487,806, entitled "Weapon Housing System for an Automatic Loading Firearm" issued to Murello et al. on Dec. 3, 2002; U.S. Pat. No. 6,499,245, entitled "Modular Sleeve Yoke" issued to Swan on Dec. 31, 2002; U.S. Pat. No. 6,508,027, entitled "Accessory Mounts for Firearms" issued to Kim on Jan. 21, 2003; U.S. Pat. No. 6,671,990, entitled "Rifle Handguard System with Single End Attachment" issued to Booth on Jan. 6, 2004; U.S. Pat. No. 6,694,660, entitled "Rifle Handguard System with Integrated Barrel Nut" issued to Davies on Feb. 24, 2004; U.S. Pat. No. 6,779,228, entitled "Accessory Mounts for Firearms" issued to Kim on Aug. 24, 2004; U.S. Pat. No. 6,679,711, entitled "Lever Type Connector" issued to Takahashi on Jan. 20, 2004; U.S. Pat. No. 6,854,206, entitled "Rail Connector and Method" issued to Oz on Feb. 15, 2005; U.S. Pat. No. 6,895,708, entitled "Accessory Mounts for Firearms" issued to Kim et al. on May 24, 2005; U.S. Pat. No. 7,131,228, entitled "Modular Firearm" issued to Hochstrate et al. on Nov. 7, 2006; United States publication number US2002/0000059 entitled "Weapon Housing System for an Automatic Loading Firearm" by Murello et al. and published on Jan. 3, 2002; United States publication number 2005/0188591 entitled "Barrel-Assembly and Attachment System" by Stone and published on Sep. 1, 2005; United States publication number 2005/0235546 entitled "Firearm, in particularly a Self-loading Small-caliber Firearm" by Wonisch et al. and published on Oct. 27, 2005; United States publication number 2005/0262752, entitled "Firearm" by Robinson et al. and published on Dec. 1, 2005; United States publication number 2006/0032103, entitled "Machine Guns Having Detachable Barrels and Methods of Operating the Same" by Wossner et al. and published on Feb. 16, 2006; United States publication number 2006/0236582, entitled "Monolithic Rail Platform and Bolt Assemblies for a Firearm" by Lewis et al. and published on Oct. 26, 2006; all of which are incorporated hereinto by reference.

SUMMARY OF THE INVENTION

The present invention provides a combination for a firearm which creates an improved firearm. When the combination is applied to a firearm, a highly improved firearm is created.

In general the present invention relates to a line of military rifles such as the M16/AR-15 which utilizes a chassis or housing to enclose the rifle's action mechanism as well as the barrel. Those of ordinary skill in the art readily recognize a variety of other firearms to which the present invention applies.

An upper chassis is created which is formed from a first housing and a second housing which, once formed in a preliminary state, are then permanently secured to each other.

The first housing is milled/stamped or otherwise formed to function as what is commonly recognized as the firearm receiver, housing all or part of the action mechanism. This housing has multiple openings that allow for the assembly and operation of the firearm, as well as attachments that interface with or enhance the operation of the action mechanism. The forward part of the housing features a port and threaded boss, which allow for the conventional mounting and attachment of the barrel assembly. Further, the first housing has an upper rail which is configured to accept peripheral devices such as illumination devices, ancillary sights, or other devices well know to those of ordinary skill in the art.

The second housing, also equipped with an upper rail, is secured by adhesive, welding or other methods to the first housing once the first housing has been created. By making the two housings separately and then joining them to form the upper chassis, manufacture of the threaded barrel mounting boss is facilitated.

Once the first and second housing are joined, in one embodiment of the invention, the rails of the first housing and the second housing go through an additional step wherein the two rails are "fine tuned" by a milling operation so that the two rails effectively become a single rail.

The upper chassis provides a first opening through which a spent cartridge is discharged and a second opening. It is the second opening which permits a variety of attachments to be secured to the upper chassis so that the firearm is customized even further for the particular use or the user of the firearm.

These peripherals which address the second opening are such items as a spent cartridge deflector or a manual bolt assist mechanism. Securing the peripherals is done through a variety of techniques such as a locking mechanism secured to the upper chassis/first housing, or by clamps which are secured to the peripheral itself.

When the above chassis is secured to the firearm, a firearm assembly is created which has a hand guard and rail platform. A third housing is secured to the second housing portion of the upper chassis to form a protective "tube" through which the barrel of the firearm extends. This tube (formed by the second housing and the third housing) does not contact the barrel and is equipped with vents to assist in cooling the barrel of the firearm.

The barrel of the firearm is position through the hand guard portion and secured to the receiver assembly by conventional mechanisms.

The assembly has a rail for the attachment of peripheral devices running continuously along the length of the upper surface. The hand guard portion optionally has additional rails for the attachment of further peripheral devices along each side.

In one embodiment of the invention, the third housing (sometimes referred to as the lower chassis) has at least one rail for the attachment of peripheral devices. The removable lower section has a heat chassis mounted therein.

Ideally this lower chassis is removable and replaced without the removal of fasteners and without the use of special tools.

The individual components are made using a variety of manufacturing techniques, including, but not limited to: forgings, casting, extrusions, or machined from solid stock and are made with a variety of materials including aluminum, steel, metal alloys, polymers and other materials obvious to those of ordinary skill in the art.

The components are permanently joined together during manufacture using conventional welding, brazing, friction "stir" welding, sonic welding, adhesives, locking pins or other appropriate methods for the materials used.

The invention, together with various embodiments thereof, will be more fully explained by the accompanying drawings and the following descriptions thereof.

DRAWINGS IN BRIEF

DRAWINGS IN DETAIL

Figure 1:
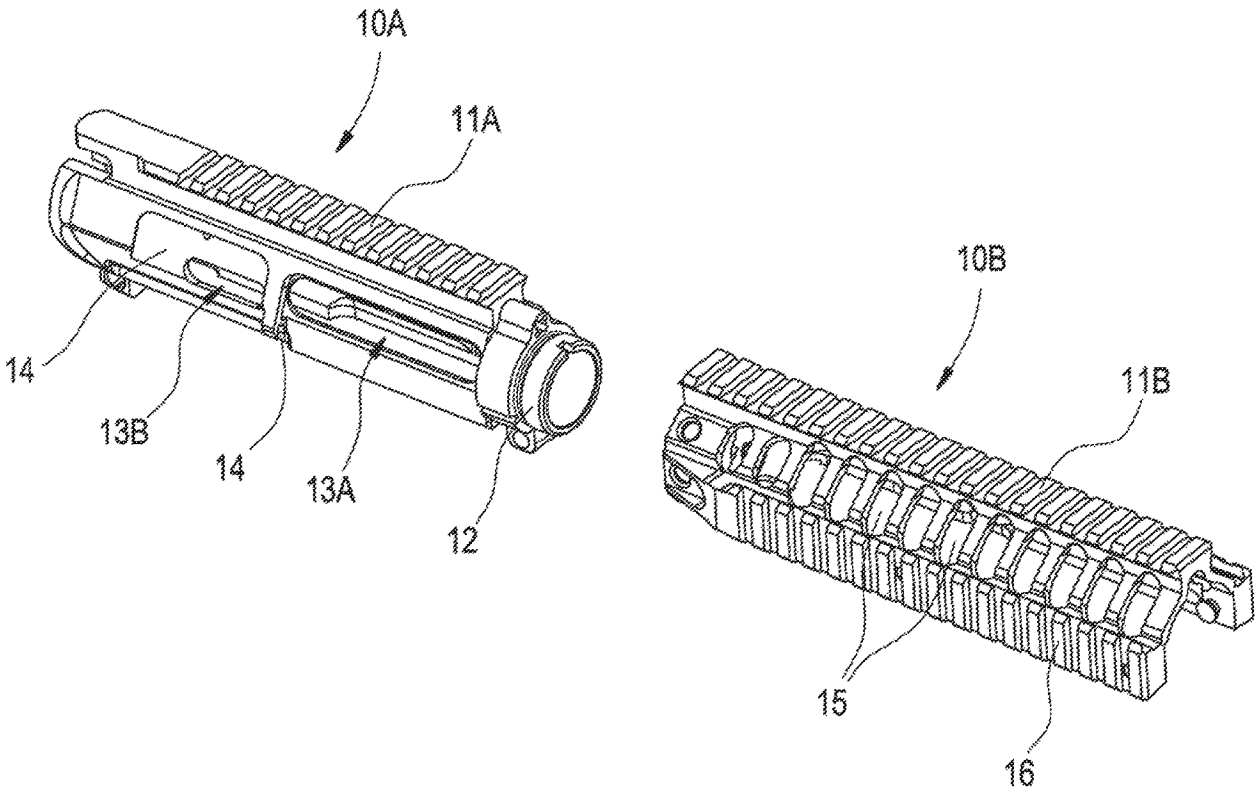
FIG. 1 is a perspective view of the preferred embodiment of the first and second housing used to enclose the action mechanism and as a upper hand-guard respectively.

FIG. 1 is a perspective view of the preferred embodiment of the first and second housing used to enclose the action mechanism and as a upper hand-guard respectively.

The first housing 10A and the second housing 10B are ideally machined from solid stock and are made of aluminum. Other embodiments of the invention utilize forging, casting, or extrusion to form the housings. A variety of materials are also available such as steel, metal alloys, and polymers. Those of ordinary skill in the art readily recognize other manufacturing techniques and materials which can be used.

Within the first housing 10A, is a first opening 13A through which a spent cartridge from the action mechanism (not shown) will be discharged; and a second opening 13B. In this embodiment of the invention, grooves 14 are provided which accept the attachment of a peripheral attachment (not shown) which at least partially obscures the second opening 13B.

An upper rail 11A is configured on the first housing 10A. In the preferred embodiment of the invention, upper rail 11A is machined into a "rough" state at this stage of the production process.

Also on the first housing 10A is an integral threaded boss 12, which permits the conventional mounting and securing of a standard barrel, as recognized by those of ordinary skill in the art.

The second housing 10B, also has an upper rail 11B which is also machined into a "rough" state. Upper rail 11B is configured to align with upper rail 11*a* when the two housings, 10A and 10B, are secured to each other.

Vent holes 15 permit heat from the barrel, which will eventually be covered by housing 10B, to escape.

Secondary rail 16, (also mirrored on the opposite side), in this embodiment, is used to attach peripheral devices such as flashlights and additional sights.

Figure 2:
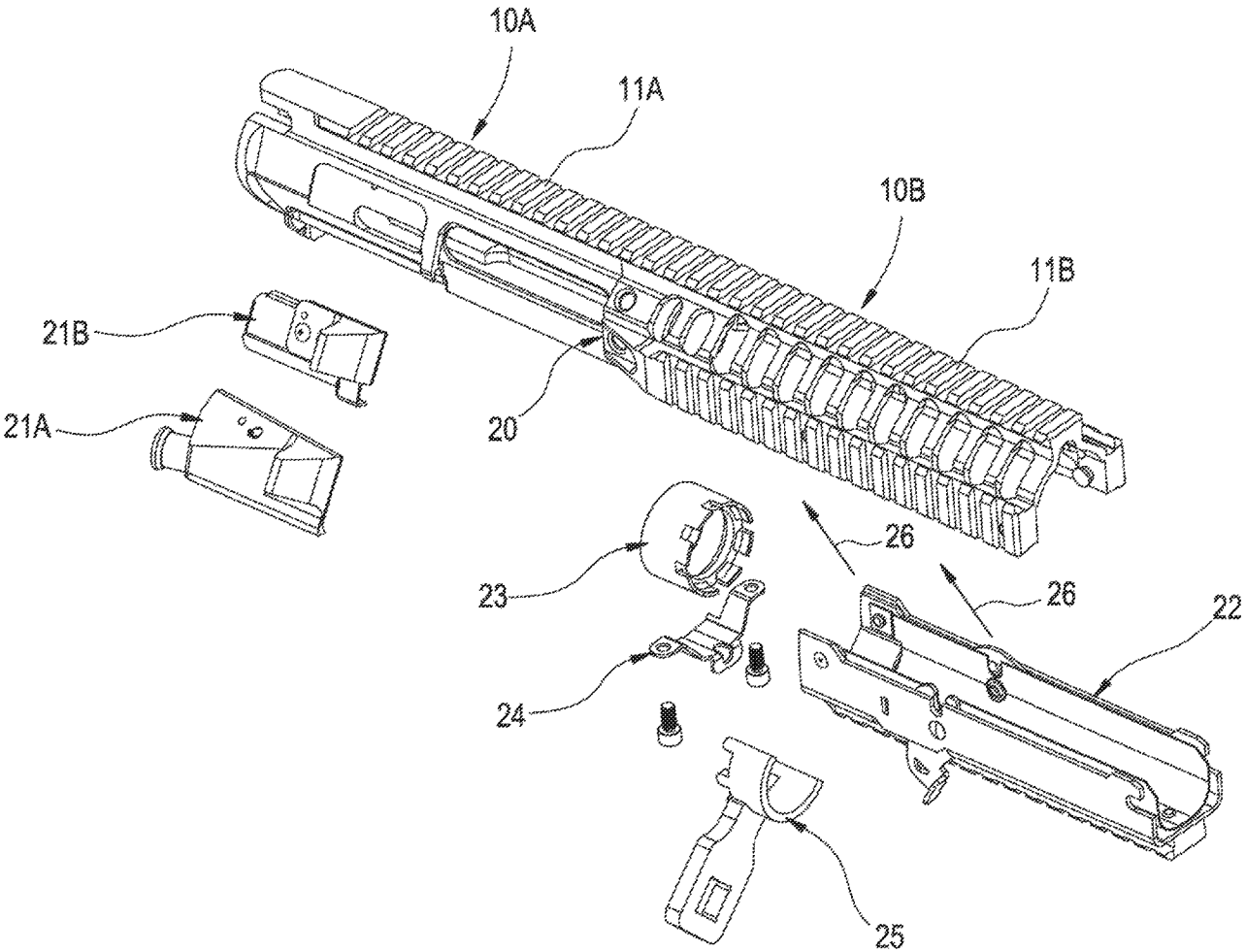
FIG. 2 is a perspective view of the preferred embodiment of the assembly showing the three housings as well as the preferred peripheral mechanisms and the barrel nut.

FIG. 2 is a perspective view of the preferred embodiment of the assembly showing the three housings as well as the preferred peripheral mechanisms and the barrel nut.

As illustrated, first housing 10A has been secured to the second housing 10B so as to form a composite unit, with upper rail 11A and upper rail 11B aligned to each other. In this embodiment, the two housing are joined using conventional welding at their intersection 20. Brazing, friction "stir" welding, sonic welding, adhesives, and locking pins are also acceptable for this bonding of the two housings.

Once the housings have been secured to each other the upper rail 11A and upper rail 11B are aligned. In this embodiment, upper rail 11A and upper rail 11B are now machined into a final or finished structure, thereby producing a unified upper rail.

Through the use of barrel nut 23, mating the threaded barrel boss (not visible in this illustration), the unified first housing 10A and the second housing 10B once connected to the action mechanism, provide a mechanism to secure the barrel to the action mechanism. Barrel nut 23 is tightened using tool 25.

Once the unified upper housing is secured to the firearm, third housing 22 is secured to the bottom of the second housing 10B as illustrated by arrows 26. The connection of the third housing 22 with the second housing 10B, provides a total encasement of the firearm's barrel (not shown) without making contact with the barrel, thereby providing a hand-guard for the firearm.

Additionally a grenade launcher bracket 24 is also optionally attached to the assembly.

Attachments such as cartridge deflection plate 21B and bolt assist mechanism 21A are securable to the first housing 10A as outlined earlier. In this manner, the firearm is easily tailored to the specific needs of the user.

Figure 3:
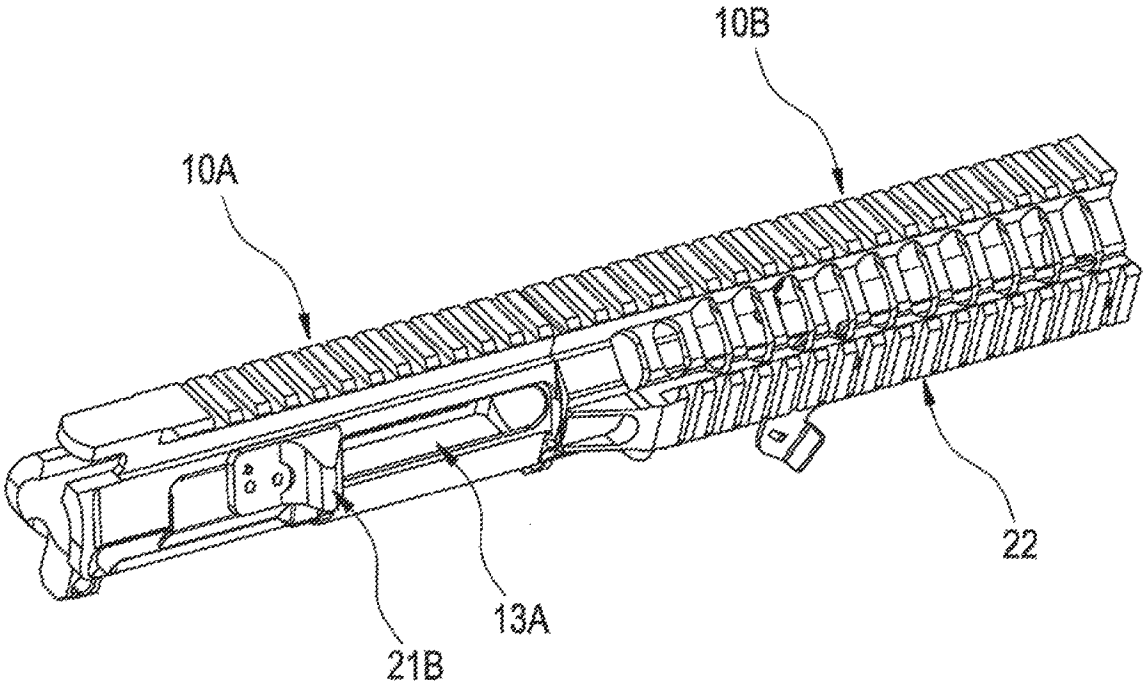
FIG. 3 is a perspective view of the assembled preferred embodiment.

FIG. 3 is a perspective view of the assembled preferred embodiment. For ease of illustration, the firearm is not illustrated.

The three housings, composite assembly 10A/10B and 22 have now been secured to each other and the assembly provides, as illustrated deflector 21B which re-directs the spent cartridges as they are ejected through opening 13B. The combination of the second housing 10B and the third housing 22 provides a vented hand-guard which surrounds the barrel of the firearm without making contact with the barrel.

It is the barrel nut and threaded barrel boss (not visible) that allows the barrel to be secured to the composite chassis; and it is through the creation of the threaded barrel boss during manufacture of the first housing prior to the bonding of the first and second housing, which allows the threaded barrel boss to be easily and properly created.

It is clear that the present invention provides for a highly improved chassis for a firearm as well an improved firearm employing the chassis.

What is claimed is:

1. A firearm upper receiver comprising:

a receiver housing extending lengthwise between a forward end and a rearward end, said receiver housing at least partially defining a receiver chamber dimensioned to at least partially receive an associated firearm action mechanism, said receiver housing including first and second openings extending therethrough in communication with said receiver chamber, said first opening disposed toward said forward end and dimensioned to permit discharge of associated spent cartridges from said receiver chamber, said second opening disposed toward said rearward end of said receiver housing relative to said first opening with said first and second openings disposed in spaced relation to one another in said lengthwise direction; and, an attachment secured to said receiver housing and at least partially obscuring said second opening, said attachment including a cartridge deflection surface oriented toward said first opening and dimensioned to deflect associated spent cartridges discharged from said first opening.

2. A firearm upper receiver according to claim 1, wherein said attachment includes a bolt assist mechanism operative to engage the associated firearm action mechanism through said second opening.

3. A firearm upper receiver according to claim 1, wherein said receiver housing includes a groove extending into said receiver housing and dimensioned to receive at least a portion of said attachment.

4. A firearm upper receiver according to claim 1, wherein said receiver housing includes a threaded boss integrally formed along said forward end of said receiver housing.

5. A firearm upper receiver according to claim 4 further comprising a barrel nut dimensioned to cooperatively engage said threaded boss for securement of an associated firearm barrel on said receiver housing.

6. A firearm upper receiver according to claim 1, wherein said receiver housing includes a port in communication with said receiver chamber, said port disposed along said forward end dimensioned to recevingly engage at least a portion of an associated firearm barrel.

7. A firearm upper receiver according to claim 1, wherein said receiver housing includes a top extending lengthwise along said receiver housing, a bottom extending lengthwise along said receiver housing opposite said top.

8. A firearm upper receiver according to claim 7, wherein said receiver housing includes a first side extending lengthwise along said receiver housing between said top and said bottom, and a second side extending lengthwise along said receiver housing between said top and said bottom opposite said first side with said first and second openings disposed along a common one of said first and second sides.

9. A firearm upper receiver according to claim 7, wherein said bottom of said receiver housing is dimensioned to operatively engage an associated firearm lower receiver.

10. A firearm upper receiver according to claim 7 further comprising a mounting rail extending lengthwise along said top of said receiver housing.

11. A firearm upper receiver according to claim 10, wherein said mounting rail is integrally formed with said receiver housing.

12. A firearm upper receiver according to claim 10, wherein said mounting rail includes a plurality of grooves disposed in spaced relation to one another in a lengthwise direction.

13. A firearm upper receiver according to claim 1 further comprising a handguard secured along said forward end of said receiver housing.

14. A firearm upper receiver according to claim 13, wherein said handguard is permanently attached to said receiving housing.

15. A firearm upper receiver according to claim 13, wherein said handguard includes a mounting rail extending lengthwise therealong.

16. A firearm upper receiver comprising:

a receiver housing extending lengthwise between a forward end and a rearward end, said receiver housing at least partially defining a receiver chamber dimensioned to at least partially receive an associated firearm action mechanism, said receiver housing including:

a top extending lengthwise along said receiver housing;

a bottom extending lengthwise along said receiver housing opposite said top;

a first side extending lengthwise along said receiver housing between said top and said bottom;

a second side extending lengthwise along said receiver housing between said top and said bottom opposite said first side;

a groove extending into said receiver housing along one of said first and second sides;

first and second openings extending through said receiver housing along said one of said first and second sides thereof, said first and second openings disposed in communication with said receiver chamber, said first opening disposed toward said forward end and dimensioned to permit discharge of associated spent cartridges from said receiver chamber, said second opening disposed toward said rearward end of said receiver housing relative to said first opening and at least partially within said groove such that said first and second openings are disposed in spaced relation to one another in said lengthwise direction; and, an attachment secured to said receiver housing and at least partially received within said groove to thereby at least partially obscure said second opening, said attachment including a cartridge deflection surface oriented toward said first opening and dimensioned to deflect associated spent cartridges discharged from said receiver chamber through said first opening.

17. A firearm upper receiver according to claim 16, wherein said attachment includes a bolt assist mechanism operative to engage the associated firearm action mechanism through said second opening.

18. A firearm upper receiver according to claim 16, wherein said receiver housing includes:

a threaded boss integrally formed along said forward end of said receiver housing; and, a port in communication with said receiver chamber, said port disposed along said forward end of said receiver housing and dimensioned to recevingly engage at least a portion of an associated firearm barrel; and, said firearm upper receiver further comprising: a barrel nut dimensioned to cooperatively engage said threaded boss for securement of the associated firearm barrel on said receiver housing.

19. A firearm upper receiver kit comprising:

a receiver housing extending lengthwise between a forward end and a rearward end, said receiver housing at least partially defining a receiver chamber dimensioned to at least partially receive an associated firearm action mechanism, said receiver housing including first and second openings extending therethrough in communication with said receiver chamber, said first opening disposed toward said forward end and dimensioned to permit discharge of associated spent cartridges from said receiver chamber, said second opening disposed toward said rearward end of said receiver housing relative to said first opening with said first and second openings disposed in spaced relation to one another in said lengthwise direction; and, at least one of:

a first attachment dimensioned for securement to said receiver housing such that at least a portion of said second opening is obscured thereby with said first attachment including a cartridge deflection surface positionable toward said first opening and dimensioned to deflect associated spent cartridges discharged from said first opening; and, a second attachment dimensioned for securement to said receiver housing such that at least a portion of said second opening is obscured thereby with said second attachment including a bolt assist mechanism operative to engage the associated firearm action mechanism through said second opening and a cartridge deflection surface positionable toward said first opening with said cartridge deflection surface dimensioned to deflect associated spent cartridges discharged from said first opening.

20. A firearm upper receiver kit according to claim 19 further comprising a handguard secured along said forward end of said receiver housing.

* * * * *